US007731309B2

(12) United States Patent
Gorini et al.

(10) Patent No.: US 7,731,309 B2
(45) Date of Patent: Jun. 8, 2010

(54) DISHWASHER

(75) Inventors: Cesare Gorini, Biandronno (IT); Marcello Milotti, Naples (IT); Giorgio Mondadori, Cameri (IT)

(73) Assignee: Whirlpool Corporation, Benton Harbor, MI (US)

( * ) Notice: Subject to any disclaimer, the term of this patent is extended or adjusted under 35 U.S.C. 154(b) by 984 days.

(21) Appl. No.: 11/452,683

(22) Filed: Jun. 14, 2006

(65) Prior Publication Data

US 2006/0284525 A1 Dec. 21, 2006

(30) Foreign Application Priority Data

Jun. 15, 2005 (EP) ..... 05105239

(51) Int. Cl.
*A47L 19/02* (2006.01)
*E03C 1/18* (2006.01)

(52) U.S. Cl. ..... 312/228

(58) Field of Classification Search ..... 312/228, 312/228.1, 311, 327, 328, 330.1
See application file for complete search history.

(56) References Cited

U.S. PATENT DOCUMENTS 2,676,477 A * 4/1954 Smith ..... 68/196
3,582,173 A * 6/1971 Noren et al. ..... 312/319.4
3,826,553 A * 7/1974 Cushing et al. ..... 312/351.3
4,295,692 A * 10/1981 Jenkins ..... 312/228
4,359,250 A * 11/1982 Jenkins ..... 312/228
4,746,177 A * 5/1988 Lampman et al. ..... 312/228
5,368,379 A * 11/1994 Wrangberth ..... 312/228
5,605,061 A * 2/1997 Durazzani ..... 68/3 R
5,711,170 A * 1/1998 Johnson ..... 68/3 R
5,741,054 A 4/1998 Becker et al.
5,860,436 A * 1/1999 Hobday ..... 134/58 D
5,924,433 A * 7/1999 Thies et al. ..... 134/200
6,719,383 B2 * 4/2004 Elick et al. ..... 312/228
7,156,113 B2 * 1/2007 Jerg et al. ..... 134/93
7,313,933 B2 * 1/2008 Carey et al. ..... 68/3 R
7,395,683 B2 * 7/2008 Kim et al. ..... 68/12.27
2004/0011390 A1 1/2004 Flowers
2004/0169449 A1 * 9/2004 Kim ..... 312/228
2005/0016569 A1 * 1/2005 Rosenbauer et al. ..... 134/105
2005/0285487 A1 * 12/2005 Noh ..... 312/228
2008/0290770 A1 * 11/2008 Rockwell et al. ..... 312/228

FOREIGN PATENT DOCUMENTS

EP 0452287 10/1991
WO 02/053009 7/2002

* cited by examiner

*Primary Examiner*—Janet M Wilkens
*Assistant Examiner*—Dan Rohrhoff
(74) *Attorney, Agent, or Firm*—John W. Morrison; McGarry Bair P.C.

(57) ABSTRACT

A dishwasher comprising a base structure on which a tub is mounted. It comprises a top structure connected to the base structure by the strut-shaped members providing a cage-shaped support structure around the tub.

16 Claims, 2 Drawing Sheets

DISHWASHER

BACKGROUND OF THE INVENTION

1. Field of the Invention

The present invention relates to a dishwasher comprising a base structure on which a tub is mounted.

2. Description of the Related Art

A dishwasher of the above type is disclosed by EP-A-452287 where the base structure is made of polymeric material and acts as a torsion stiff shell structure. In this known solution the upper part of the tub is shaped as a box which is open at the front and at the bottom and it is placed on the base structure. For producing such box-shaped tub it is described to start from a sheet of stainless steel, to bend it as a U-shaped component and to join it, for instance by welding, to another piece of sheet metal forming the upper fourth wall of the tub or washing container. This known approach does not appear to allow reducing sufficiently the production costs compared to the production of a traditional dishwasher where a base structure of polymeric material is not used.

Another similar solution is disclosed by WO 02/053009 that relates to a rinsing container for a dishwashing machine where a frame structure made of plastic is provided, such structure supporting a U-shaped casing part closed on its open side by a wall integral with the frame structure. In this document, applicants can find no teaching or suggestion of how the upper portion of the rinsing container is made, and the fact that the rinsing container is only open on its top suggests that the use of such rinsing container is suitable only for peculiar uses, such as in worktops or drawers of kitchen furniture.

SUMMARY OF THE INVENTION

One object of the present invention is to provide a dishwasher of the type specified at the beginning of the description with a low production cost, so to render such kind of domestic appliance accessible to a wider group of customers, particularly considering that dishwashing machines are still quite expensive domestic appliances.

According to one aspect of the invention, strut-shaped members are adapted to cooperate with a base structure and a top structure in order to provide a cage-shaped support structure outside the tub.

Thanks to this feature there is no need to weld different components in order to produce the tub, since the latter is made by a U-shaped metal sheet element interposed between the base and the top, and by the floor and ceiling portion of the base and top structures respectively, preferably made of plastic. The stiffness of the overall structure is assured by the combination of the base and top joined together along the vertical strut-shaped members that act together as a structural cage around the U-shaped metal casing that has just a container function. This innovative way of building a dishwasher has many advantages over prior art. The top of the dishwasher has integrated therein the control boards of the machine, the detergent and rinse-aid dispenser (traditionally placed in the door that now, according to the invention, does not need any electrical connections), the water softener, the salt container and related electric and hydraulic connections. The top has integral conduits for water entrance with air break devices.

The base structure has integrated conduits for water circulation and seats for washing and draining pumps and other components. It presents two main zones: an upper zone forms the tub bottom itself and is provided with a seat for sealing the steel body. The rails for the lower basket and the support for the lower spray arm are parts of the upper zone. In the lower zone there are provided the support for the pumps, heat exchanger and other components. The combination of upper and lower zone defines the channels for the runners. It creates the basement itself with easy connection for the door hinges. The connection between the base and the top is snap fit, but also screws or other fastening devices can be used.

According to one embodiment of the invention, the upper face of the base structure is provided with a thin layer/foil of stainless steel in order to give a better aestethical impression to the customer/user. In this way the tub has the same appearance of a traditional dishwasher with a stainless steel tub.

According to another embodiment of the invention, with the aim to further reduce the cost of the appliance, a single gasket is used for the door, which is fitted all around the front opening of the tub. This gasket prevents water leakage between tub and door and it also hides the screw heads that hold the side panels together with the body.

The water connection from the water supply is made on the top. Draining connection, i.e. the connection to the pipe for pumping out water from the tub, is made on the base structure. Electrical connections and power circuit (pumps, heat exchanger) are located in the base, while low-tension circuit is located on the top structure.

The dishwasher according to the invention can be either a built-in or freestanding machine. The built-in version can leverage the same basic structure (i.e. metal tub+base+top). The decision to make a free standing or built-in version can be easily taken at the end of the assembly line, since all major components are in common for the two versions.

Further advantages and features of a dishwasher according to the invention will be described with reference to the accompanying drawings.

Figure 1:
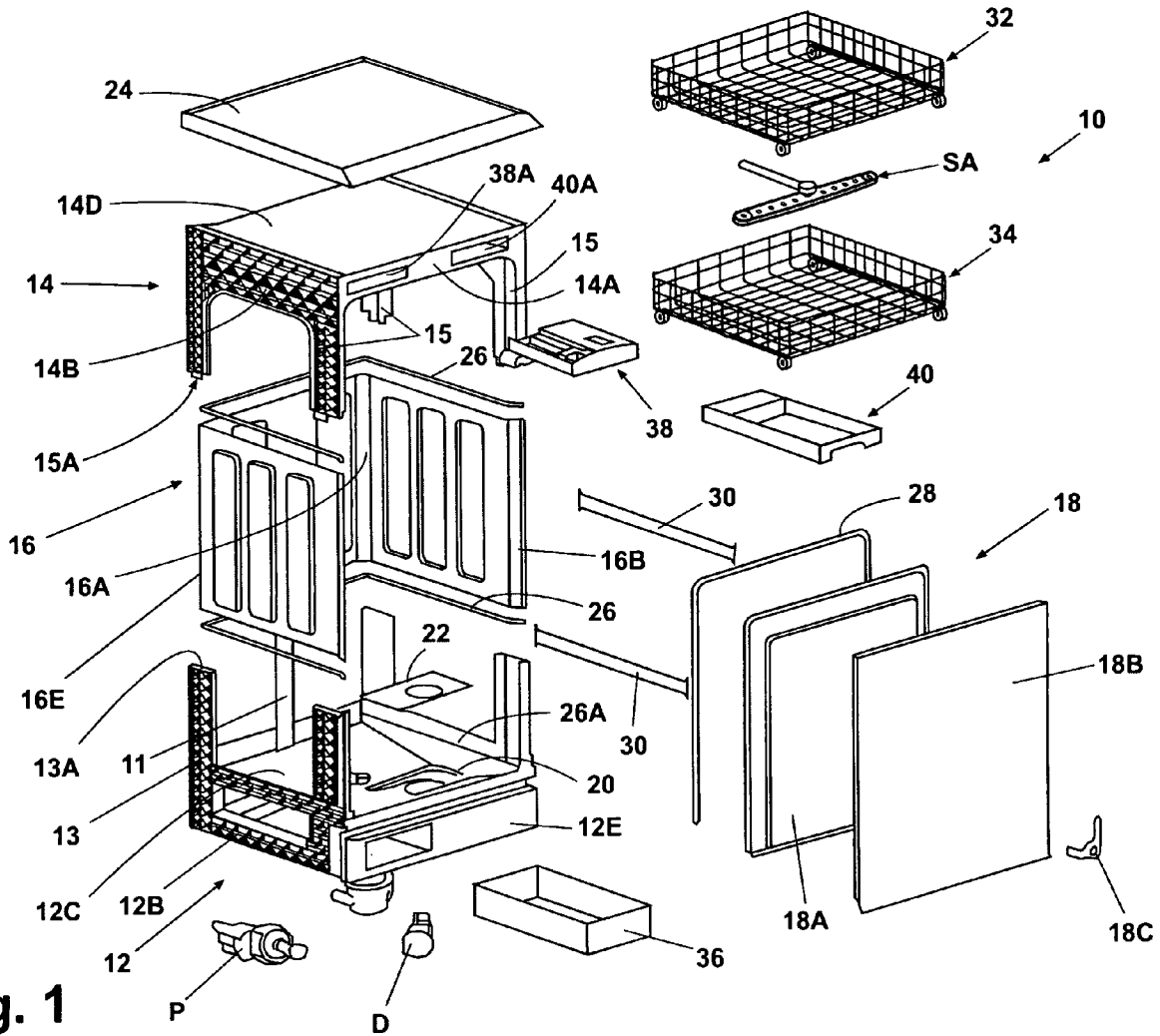
FIG. 1 is a perspective exploded view of a dishwashing machine according to the invention.
Figure 3:
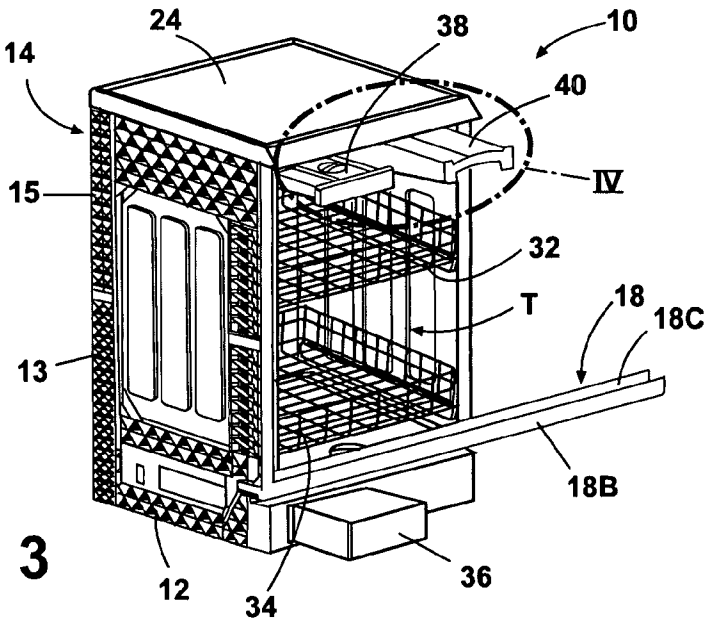
FIG. 3 is a perspective view of the dishwashing machine of FIG. 2, in an open configuration.
Figure 4:
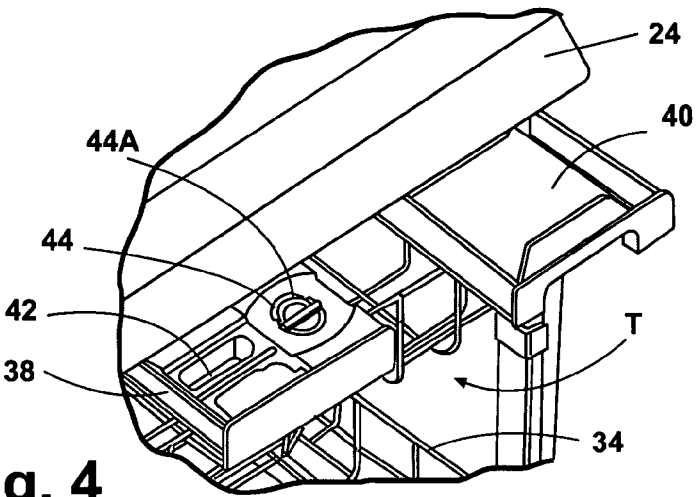
FIG. 4 is a detail of FIG. 3.

With reference to the drawings, with 10 it is indicated a dishwasher having a base structure 12, a top structure 14, a metal body 16 and a front door 18. The base and the top structure 12 and 14 are made of polymeric material, for instance polypropylene(filled or not filled) or other polymeric materials compatible with the chemical environment inside the tub, and are produced by an injection molding process. The base structure 12 is shaped as a square plinth and presents a front wall 12*a*, two side walls 12*b* and an upper wall 12*c* which forms the floor of the tub T of the dishwasher. The upper wall 12*c* of the base structure has a seat 20 for a traditional sieve 22 and has also a seat for the lower spray arm. The base structure 12 presents also four vertical strut members 13 projecting upwardly which are substantially flush with the side walls 12*b* and whose function will be clear from the following description. The two rear strut members 13 of the base structure 12 have a L-shaped cross section. Integral with the base structure 12, there is provided a conduit 11 (FIG. 1) for hydraulically connecting the circulation pump P (downstream the sieve 22) with the upper spray arm SA (FIG. 1).

The top structure 14 has a general square shape substantially similar to the base structure 12, and it has a front wall 14*a*, two side walls 14*b* and an horizontal lower wall which forms the ceiling of the tub T of the dishwasher. The top structure 14 presents also an upper horizontal wall 14*d* on which (in the freestanding version of the dishwasher) a decorative top panel 24 can be mounted. Similarly to the base structure 12, the top structure 14 presents four vertical strut members 15 projecting downwardly with ends 15*a* so shaped to be connected with corresponding shaped ends 13*a* of the strut members 13 of the base structure. The two rear strut members 15 of the top structure 14 have a L-shaped cross section.

According to another embodiment, the strut members are integral with the top structure only, and are connected to the upper peripheral zone of the base structure. It is also possible to provide the strut members as integral with the base structure only, and to connect them to the lower peripheral zone of the top structure.

Both the base structure 12 and the top structure 14 have seats for rubber gaskets 26 (FIG. 1). Only the seat of the base structure 12, indicated with reference 26*a,* is shown in the drawings. Between the base structure 12 and the top structure the metal body 16 is interposed, which is made by a stainless steel metal sheet folded along vertical corners 16*a* in order to form the side walls and the rear wall of the tub T. The L-shaped cross section of the rear members 13 and 15 allows such members to embrace the metal body 16 in the zones of corners 16*a* thereof. The metal body 16, the base structure 12 and the top structure 14 make a watertight tub T thanks to the gaskets 26. The metal body 16 further presents two shaped front edges 16*b* where a front door gasket 28 is mounted. On the side walls of the metal body 16 telescopic rails 30 for an upper basket 32 are fixed in a conventional way, while a lower basket 34 can slide on rails integral with the base structure 12.

In the base structure 12, on the bottom portion thereof, there are provided seats for the circulation pump P, for the drain pump D and for other usual components of a dishwasher. According to a preferred embodiment of the invention, the base structure 12 does not support the water softener with its salt container. Therefore there is more space in the base structure 12 for mounting a drawer 36 which slides in a corresponding opening 36*a* in the front wall 12*a* of the base structure. The drawer 36 can be used for storing detergents or brightners to be used in the machine.

According to another feature of the dishwasher according to the invention, the top structure 14 has the front wall 14*a* provided with housings 38*a* and 40*a* for sliding drawers 38 and 40 respectively. The drawer 38 is adapted to contain detergent and auxiliary chemicals to be used in the washing process of the dishwasher. In particular, the drawer 38 has a first seat 42 for powder or tablet detergents, and a seat 44 closed by a plug 44*a* for a containing liquid brightner. During the washing cycle of the dishwasher 10, the detergent drops by gravity into the tub T and possible detergent remnants are washed out by spray arms. The housing 38*a,* in the configuration shown in FIG. 2 (door closed), is not accessible from outside and this feature makes the hydraulic connections simpler, since any leak from the housing 38*a* or from the drawer 38 is conveyed to the tub T.

The drawer 40 contains the salt to be used in the water softener that is supported in a seat of the top structure 14. Therefore the user does not need to bend down for loading detergent, brightner or salt, and the door 18 does not need any electrical connection. The door 18 comprises only a stainless steel liner 18*a* connected to a front panel 18*b,* which are articulated to the base structure 12 by the braces 18*c*.

For the assembly of the dishwasher 10, the base structure 12 is seated upside down and all related electrical equipment are assembled on it. The base structure 12 is then rotated and the metal body 16, preliminarily put in a template, is assembled on it. All the mechanical and low-voltage electrical and electronic equipment is previously assembled in a separate line on the top structure 14. The pre-assembled top structure 14 will then be placed on the metal body 16 and its strut members 15 will be coupled to the corresponding strut members 13 of the base structure 12. The strut members 13 and 15 can be screwed together or there can be provided a snap engagement system by shaping the ends 13*a* and 15*a* of the strut members accordingly. Of course the members 13 and 15 can also be welded together. The door 18 will then be simply inserted in its supports or braces 18*c* which are previously fitted on the base structure 12 and linked to balancing springs.

Figure 2:
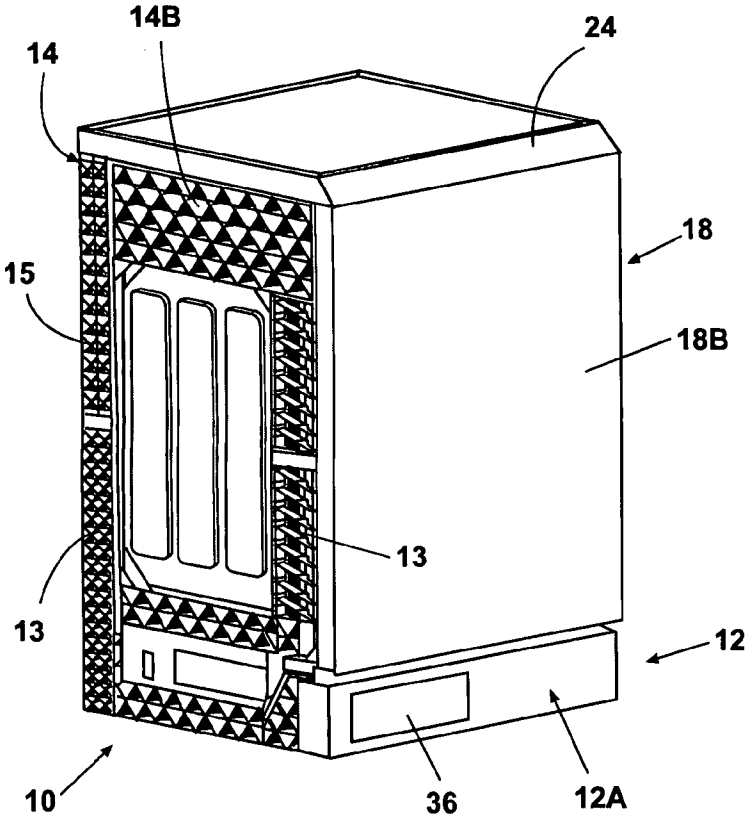
FIG. 2 is a perspective view of the dishwashing machine according to FIG. 1 in an assembled configuration thereof.

On the dishwasher shown in FIG. 2 side panels can be easily mounted on the side portions of the base and top structures 12 and 14.

The invention claimed is:

1. A dishwasher comprising:

a base structure on which a tub is mounted, a top structure connected to the base structure by strut-shaped members, wherein the tub comprises a U-shaped metal sheet element interposed between the base structure and the top structure in order to define three side walls of the tub and a front opening thereof, with the U-shaped metal sheet element defining an open bottom closed by the base structure to form a bottom of the tub, an open top closed by the top structure to form a top of the tub; and a door having a lower portion hingedly mounted to the base structure to selectively close the front opening.

2. The dishwasher according to claim 1, wherein the strut-shaped members comprise first members integral with the base structure and corresponding second members integral with the top structure.

3. The dishwasher according to claim 1, wherein the base structure and the top structure are made of polymeric material.

4. The dishwasher according to claim 2, wherein the first and second strut-shaped members are substantially vertical and are placed on side parallel walls of the U-shaped metal sheet element of the tub.

5. The dishwasher according to claim 2, wherein the first and second strut-shaped members present ends provided with fastening devices for assembling members together.

6. The dishwasher according to claim 1, wherein the base structure further comprises a drawer.

7. The dishwasher according to claim 1, wherein the base structure has an integral pipe for connecting a circulation pump to a spray arm.

8. The dishwasher according to claim 1, wherein the top structure presents a housing for a drawer adapted to be loaded with detergent or a rinse aid.

9. The dishwasher according to claim 1, wherein the base structure comprises an upper layer of stainless steel.

10. A method for producing a dishwasher, comprising the steps of providing a base structure having vertical strut-shaped members projecting upwardly, providing a top structure having vertical strut-shaped members projecting downwardly, joining the base structure and the top structure at the ends of the corresponding vertical strut-shaped members in order to define a structural cage; placing a U-shaped metal body within the structural cage to define a tub having three side walls and a front opening; and hingedly connecting a door to the base structure for selectively closing the front opening.

11. A dishwasher comprising:

a base structure having first strut-shaped members on which a tub is mounted;

a top structure having second strut-shaped members connected to the strut-shaped members of the base structure to define an interior with an open face;

a tub comprising a U-shaped metal sheet element interposed within the interior between the base structure and the top structure to define three side walls of the tub and a front opening confronting the open face; and a door hingedly mounted to the base structure to selectively close the front opening.

12. The dishwasher according to claim 11, wherein the base structure and the top structure are made of polymeric material.

13. The dishwasher according to claim 11, wherein the base structure further comprises a drawer.

14. The dishwasher according to claim 11, wherein the base structure has an integral pipe for connecting a circulation pump to a spray arm.

15. The dishwasher according to claim 11, wherein the top structure presents a housing for a drawer adapted to be loaded with detergent or a rinse aid.

16. The dishwasher according to claim 11, wherein the base structure comprises an upper layer of stainless steel.

* * * * *